US005218171A

United States Patent [19]

Aldissi

[11] Patent Number: 5,218,171

[45] Date of Patent: Jun. 8, 1993

[54] WIRE AND CABLE HAVING CONDUCTIVE FIBER CORE

[75] Inventor: Mahmoud Aldissi, Colchester, Vt.

[73] Assignee: Champlain Cable Corporation, Winooski, Vt.

[21] Appl. No.: 797,585

[22] Filed: Nov. 25, 1991

[51] Int. Cl.[5] ..... H01B 5/08

[52] U.S. Cl. ..... 174/128.1; 174/113 C; 174/126.2; 174/126.4; 174/131 A; 428/626; 428/634; 428/673

[58] Field of Search ..... 174/126.1, 126.2, 126.4, 174/128.1, 120 R, 131 A, 113 G; 428/673, 634, 607, 626

[56] References Cited

U.S. PATENT DOCUMENTS

| | | | |
|---|---|---|---|
| 2,131,478 | 9/1938 | Mann | 174/105 R |
| 2,616,165 | 11/1952 | Brennan | 174/113 C |
| 2,848,390 | 8/1958 | Whitehurst et al. | 174/113 C |
| 2,938,821 | 5/1960 | Nack | 174/113 C |
| 4,518,632 | 5/1985 | Jones | 174/120 SR |
| 4,634,805 | 1/1987 | Orban | 174/128.1 |
| 4,762,603 | 8/1988 | Morin | 174/36 |
| 5,103,067 | 4/1992 | Aldissi | 174/74 R |

*Primary Examiner*—Morris H. Nimmo
*Attorney, Agent, or Firm*—Salzman & Levy

[57] ABSTRACT

The present invention is a method of fabricating a wire and cable article capable of meeting stringent aerospace specifications and requirements, particularly that of low weight. The article generally comprises an inner conductive central core of one or more metal-coated fibers. The conductive core is preferably comprised of silver-coated aramid fibers having a silver coating of greater than 30 wt. % of the fiber, and generally several hundred weight percent thereof. The silver is coated upon aramid fibers to provide a cable having approximately half the weight and approximately 15 times the tensile strength of cables having equivalent resistance and/or equivalently sized cores of silver plated copper. The metal coating of the inventive process is accomplished in two steps: (a) a high tensile strength fiber comprising nylon, aramid, etc., is first plated with a first layer of metal such as copper, silver, etc.; and then (b) electrochemically plated with a second layer of metal. Cables fabricated in accordance with the invention can have conductive central core elements comprising one or more metal coated fibers that are either straight, twisted and/or comprised of straight or twisted bundles.

13 Claims, 1 Drawing Sheet

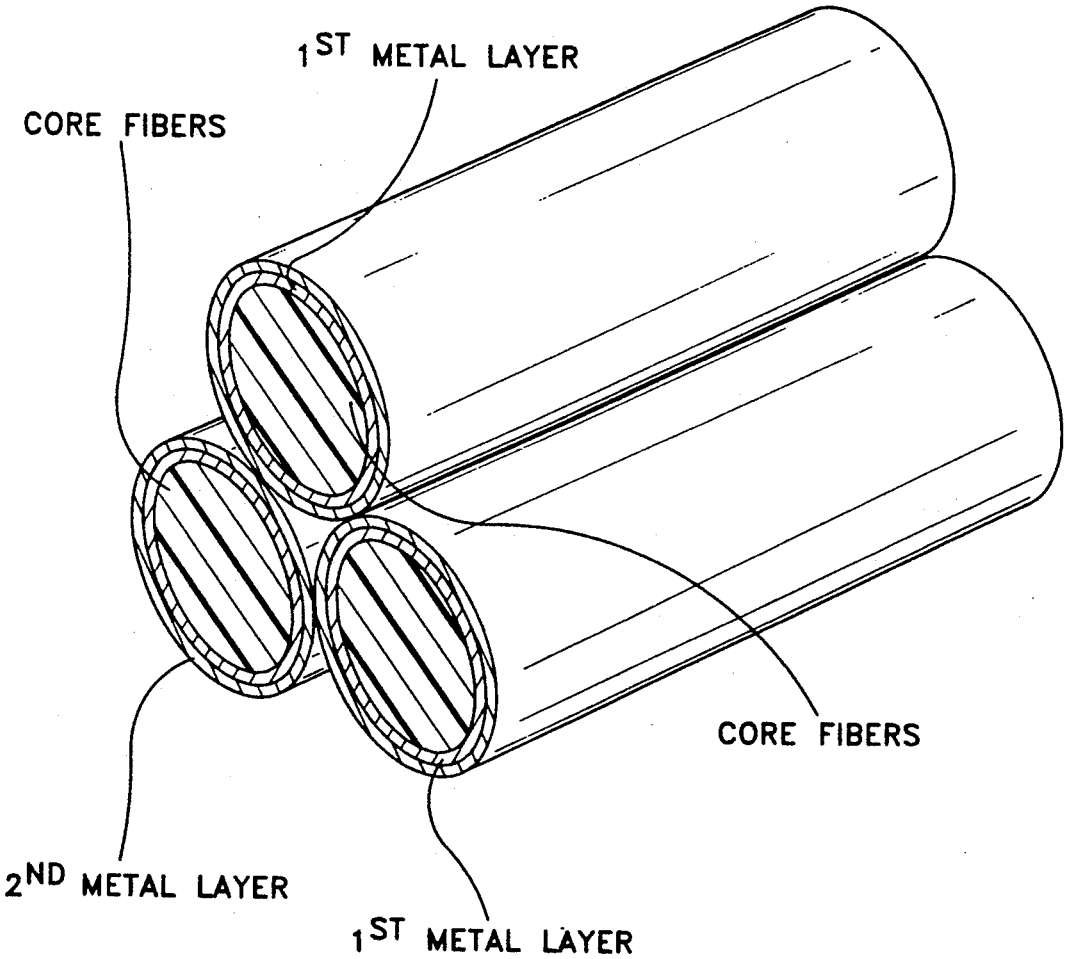
1ST METAL LAYER
CORE FIBERS
CORE FIBERS
2ND METAL LAYER
1ST METAL LAYER

WIRE AND CABLE HAVING CONDUCTIVE FIBER CORE

FIELD OF THE INVENTION

The invention relates to a wire and cable having a conductive center core comprising metal coated fibers, and more particularly to a wire and cable whose center core comprises silver coated aramid fibers of increased silver thickness and higher conductivity than heretofore possible.

BACKGROUND OF THE INVENTION

Advanced technological uses for wire and cable have imposed many new requirements upon traditional wire and cable specifications and functions. In missile and aerospace environments, for example, the need for lighter weight cabling is directly related to aircraft performance and operating cost. Also, wiring is often required to meet stringent tensile strength specifications, since it is contemplated that the missile or aircraft will have to fly at ever increasing speeds.

The aforementioned U.S. Pat. No. 5,103,067, teaches the use of silver coated aramid fibers fabricated into a mesh layer for shielded wire and cable.

In order to achieve cable of high conductivity, light weight, high tensile strength and flexibility, it is contemplated to use silver coated aramid fibers to replace the traditional conductive metal strands of the central conductive wire core.

Silver-coated aramid fibers for center conductor core applications, however, do not presently have enough conductivity to meet the specifications for high technological use. To increase the conductivity of the metal-coated aramid fibers, it is necessary to increase the thickness of the silver coating. However, the present plating limit for the silver thickness is generally thirty weight percent (30 wt %), produced by traditional plating methods.

The invention has fabricated silver-coated aramid fibers of higher conductivity by means of coating additional silver upon the aramid fibers via an electrochemical process. It is, therefore, now possible to provide silver-coated aramid fibers as a replacement for traditional wire and metal conductive core elements.

Cable fabricated with these improved fibers have a clear weight advantage, as well as having improved flexibility and tensile strength, over traditional cable featuring a metallic wire core.

The electrochemical process of this invention, allows for precise control of metal thickness, thus producing layers of silver to meet demanding and stringent conductivity requirements.

Electrochemical deposition by itself cannot provide acceptable coatings due to its poor adherence to the fiber core. Plating by itself is limited in the amount of metal that can be coated upon the fiber base.

The invention has discovered, however, that first plating the silver in any thickness up to its limits, and then applying an additional thickness of silver by electrochemical plating is possible, and highly favorable.

The success of the inventive method, and new cable article resulting from the new fabrication technique, is due to the improved adherence of the silver electrochemically deposited upon an already plated silver base layer.

The combination of the two coating methods provides a silver layer whose thickness is much greater than that previously achieved, i.e. substantially beyond the previous limit of thirty weight percent (30 wt %.). The added metal thickness is generally several hundred weight percent of the fiber. Therefore, the core conductivities equal that of pure metal wired cores alone. The conductive fibers of this invention are approximately five hundred times more conductive than the chemically plated fibers of the prior art.

The cable fabricated with a silver-coated, aramid fiber as the central core will be more flexible and of greater tensile strength. The new metal-coated fiber core eliminates the previous cracking problem inherent with cables containing metal wire cores flexed, bent or stretched beyond their physical limits.

The main advantage of the invention, however, is the substantial reduction in weight of the cable of the invention compared with standard cable having a metal wire core.

SUMMARY OF THE INVENTION

In accordance with the present invention, there is provided a method of fabricating a wire and cable article capable of meeting stringent aerospace specifications and requirements, particularly that of low weight. The article generally comprises an inner conductive central core of one or more metal-coated fibers. The conductive core is preferably comprised of silver-coated aramid fibers having a silver coating of greater than 30 wt. % of the fiber, and generally several hundred weight percent thereof. The silver is coated upon aramid fibers to provide a cable having approximately half the weight and approximately 15 times the tensile strength of cables having equivalent resistance and/or equivalently sized cores of silver plated copper. The metal coating of the inventive process is accomplished in two steps: (a) a high tensile strength fiber comprising nylon, aramid, etc., is first plated with a first layer of metal such as copper, silver, etc.; and then (b) electrochemically plated with a second layer of metal. Cables fabricated in accordance with the invention can have conductive central core elements comprising one or more metal coated fibers that are either straight, twisted and/or comprised of straight or twisted bundles.

BRIEF DESCRIPTION OF THE DRAWING

THE FIGURE illustrates a cable constructed in accordance with the invention.

DESCRIPTION OF THE PREFERRED EMBODIMENT

Generally speaking, the present invention, as illustrated in the FIGURE, features a wire and cable article whose central core element is fabricated from metallic coated fibers fabricated in a two step metal deposition process. The fibers are chosen for their high tensile strength and flexibility. The first metal layer deposited upon the fibers is provided by a standard metal plating process, described in U.S. Pat. Nos. 3,792,520, 3,877,965 and 4,042,737. The first plated layer of metal exhibits good adhesion to the fiber base. To this first metal layer is then added a second metal layer of the same or different metal by means of an electrochemical deposition process described or defined by ASTM B-700. The combined metal layers will provide a conductive core element equivalent in conductivity to standard metal wire cores, utilizing for example, silver coated copper wire strands. The second electrochemical technique can deposit precise thicknesses of the metal, such that a very precise wire or cable article can be produced.

The fibers can be chosen from many high tensile strength materials, such as nylon, Kevlar (an aromatic polyamide or aramid), carbon fibers, etc. The fibers generally have a weight range of approximately between 50 to a few hundred denier, and is some cases up to 10,000 denier.

EXAMPLE

A central core for a wire or cable article was fabricated utilizing the following materials:

For the conductive core, a 100 micrometer diameter fiber was chosen. The fiber was layered with silver in accordance with the two layer, two step process of this invention. The fiber chosen was Kevlar, an aramid fiber manufactured by DuPont De Nemours, of Wilmington, Del. The silver was plated upon the aramid in two layers. The first layer was deposited in a first plating process according to U.S. Pat. Nos. 3,792,520, 3,877,965 and 4,042,737, to a thickness whose silver content was approximately 30 wt. % of the Kevlar. The first layered core had a resistance of approximately 300 Ω/ft.

To this first layer, a second layer of silver was deposited thereupon, utilizing an electrochemical plating process according to ASTM B-700. The second layer was deposited to a thickness that provided a total silver content of approximately 80 wt. % silver, and a resistance of approximately 0.6 Ω/ft. This resistance value was 500 times the conductivity of the conductivity provided by the first layer, and was equivalent to silver plated copper or silver-copper alloy cores of similar size.

It is to be noted, that the electrochemical deposition is so precise, that a final silver thickness could be controlled to within a fraction of a micrometer.

The tensile strength of the silver coated, 100 micrometer diameter fiber of the conductive core element of this example, was approximately 15 times that of an equivalent silver plated copper conductor AWG 38, or 3 times that of an equivalent solid copper conductor of AWG 30. The tensile strength of the conductive core of the invention was approximately 7.75 lbs., as compared with 0.5 lbs. for 38 AWG solid copper. The weight of the conductive core of this example, was approximately 45% that of the metal wire.

The fibers making up the core of this invention can be layered with metals in thicknesses having many times the weight of the base fiber.

The fibers can be twisted and/or bundled to form larger diameter cores, or can be plated for small gauge applications. The conductivity of the conductive cores can be sufficiently high for DC conductivity applications as well as RF cable applications.

The conductive core of the invention can be overlaid with a wide variety of insulative materials and layers to suit the particular usage or purpose. For example, a layer of primary insulation can comprise a material, such as: Kynar 460 polyvinylidene fluoride supplied by Atochem Company, or a material, such as: Exrad ®, an irradiated, cross-linked ethylene tetrafluoroethylene copolymer manufactured by Champlain Cable Corporation, Winooski, Vt.

The first and second layers of metal can be the same or different, for example copper overlaid with silver, silver overlaid with silver, copper overlaid with tin, etc.

Each of the first and second layers can comprise a metal selected from a group of metals consisting of: copper, tin, silver, nickel, zinc, gold, and alloys thereof.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented by the subsequently appended claims.

What is claimed is:

1. A conductive core element for a wire or cable article, comprising a flexible, high tensile strength fiber having a first layer of metal up to a weight percent of the fiber of approximately 30, overlaid with a second layer of a metal, said first and second layers of metal having a total weight percent of said flexible fiber greatly in excess of said 30 weight percent, and wherein said resulting conductive core has an approximate conductivity equivalent to a metal wire conductive core of equivalent size.

2. The conductive core element in accordance with claim 1, wherein said flexible, high tensile strength fiber is selected from a group of flexible fibers consisting of: nylon, aramid, and carbon fibers.

3. The conductive core element in accordance with claim 1, wherein said second layer of metal comprises a metal different from said metal of said first layer of metal.

4. The conductive core element in accordance with claim 2, wherein said second layer of metal comprises a metal different from said metal of said first layer of metal.

5. The conductive core element in accordance with claim 1, wherein at least one of said first and second layers of metal comprises silver.

6. The conductive core element in accordance with claim 2, wherein at least one of said first and second layers of metal comprises silver.

7. The conductive core element in accordance with claim 1, wherein said first and second layers of metal are each selected from a group of metals consisting of: copper, tin, silver, nickel, zinc, gold, and alloys thereof.

8. The conductive core element in accordance with claim 2, wherein said first and second layers of metal are each selected from a group of metals consisting of: copper, tin, silver, nickel, zinc, gold, and alloys thereof.

9. The conductive core element in accordance with claim 1, wherein said conductive core element is part of a multi-element core member.

10. The conductive core element in accordance with claim 1, wherein said conductive core element is part of a multi-element core having fibers that are twisted within said multi-element core.

11. The conductive core element in accordance with claim 1, wherein said conductive core element is part of a multi-element core having fibers that are bundled within said multi-element core.

12. The conductive core element in accordance with claim 1, wherein said conductive core element is part of a multi-element core having fibers that are straight within said multi-element core.

13. A wire or cable article comprising the conductive core element of claim 1.

* * * * *